US011446842B2

(12) United States Patent
Hemmelgarn

(10) Patent No.: US 11,446,842 B2
(45) Date of Patent: Sep. 20, 2022

(54) PORTABLE CONSTRUCTION MIXER

(71) Applicant: Better Manufacturing LLC, Portland, IN (US)

(72) Inventor: Dave Hemmelgarn, Portland, IN (US)

(73) Assignee: Better Manufacturing LLC, Portland, IN (US)

( * ) Notice: Subject to any disclaimer, the term of this patent is extended or adjusted under 35 U.S.C. 154(b) by 0 days.

(21) Appl. No.: 17/018,037

(22) Filed: Sep. 11, 2020

(65) Prior Publication Data

US 2021/0078202 A1 Mar. 18, 2021

Related U.S. Application Data

(60) Provisional application No. 62/899,420, filed on Sep. 12, 2019.

(51) Int. Cl.

| | |
|---|---|
| ***B28C 5/14*** | (2006.01) |
| ***B28C 5/08*** | (2006.01) |
| ***B01F 27/703*** | (2022.01) |
| ***B01F 27/2322*** | (2022.01) |
| ***B01F 35/75*** | (2022.01) |
| ***B01F 101/28*** | (2022.01) |

(52) U.S. Cl.

CPC ..... *B28C 5/146* (2013.01); *B01F 27/2322* (2022.01); *B01F 27/703* (2022.01); *B01F 35/754551* (2022.01); *B28C 5/085* (2013.01); *B28C 5/0893* (2013.01); *B01F 2101/28* (2022.01)

(58) Field of Classification Search

CPC ..... B28C 5/146; B28C 5/085; B28C 5/0893; B28C 5/0887; B28C 5/1223; B28C 7/064; B01F 7/00975; B01F 7/043; B01F 15/0289; B01F 2215/0047; B01F 7/00433; B01F 7/08; B01F 13/0032; B01F 27/2322; B01F 27/703; B01F 35/754551; B01F 2101/28; B01F 27/1145; B01F 27/72; B01F 33/5013

USPC ..... 366/320; 184/105.3

See application file for complete search history.

(56) References Cited

U.S. PATENT DOCUMENTS

| | | | | |
|---|---|---|---|---|
| 998,762 | A * | 7/1911 | Faller | B28C 5/026 366/11 |
| 2,538,891 | A * | 1/1951 | Zimmerman | B28C 5/1276 366/156.1 |
| 2,864,594 | A * | 12/1958 | Martinek | B01F 7/30 366/287 |
| 2,869,842 | A * | 1/1959 | Schmidt | F16B 7/00 366/326.1 |

(Continued)

*Primary Examiner* — Charles Cooley

(74) *Attorney, Agent, or Firm* — Taft Stettinius & Hollister LLP; Derek B. Lavender

(57) ABSTRACT

A portable mixer that has a first auger, a second auger, a motor, a material loading location, where material may be loaded into the mixer, and a dispensing conduit. The motor powers both the first auger and second auger. Further, the second auger may rotate in a first rotational direction and a second rotational direction and the second auger substantially prevents material from exiting a dispensing conduit when the second auger rotates in the first rotational direction and the second auger distributes material through the dispensing conduit when the second auger rotates in the second rotational direction.

18 Claims, 5 Drawing Sheets

(56) References Cited

U.S. PATENT DOCUMENTS

| | | | | | |
|---|---|---|---|---|---|
| 2,905,451 | A * | 9/1959 | Thomas | B01F 7/30 | 366/244 |
| 3,006,615 | A * | 10/1961 | Mason, Jr. | B28C 5/1276 | 366/20 |
| 5,203,628 | A * | 4/1993 | Hamm | B28C 9/0454 | 366/2 |
| 5,354,127 | A * | 10/1994 | Del Zotto | B01F 7/087 | 366/186 |
| 5,524,796 | A * | 6/1996 | Hyer | B65G 33/18 | 198/662 |
| 6,030,112 | A * | 2/2000 | Milek | B01F 7/00391 | 366/320 |
| 7,270,469 | B2 * | 9/2007 | Goode | B28C 5/34 | 366/153.2 |
| 7,784,996 | B1 * | 8/2010 | Cummer | B01F 7/00158 | 366/50 |
| 10,259,140 | B1 * | 4/2019 | Derose | B28C 5/1246 | |
| 10,543,620 | B1 * | 1/2020 | Derose | B01F 13/0033 | |
| 11,285,639 | B2 * | 3/2022 | Scott | B28C 5/143 | |
| 11,291,211 | B2 * | 4/2022 | Tsai | B01F 35/754551 | |
| 2001/0027900 | A1 * | 10/2001 | Wilcox | F16C 33/6625 | 184/105.3 |
| 2008/0130406 | A1 * | 6/2008 | Rosso | B01F 7/00275 | 366/342 |
| 2011/0211419 | A1 * | 9/2011 | Anderson | B01F 7/00583 | 366/64 |
| 2021/0078202 | A1 * | 3/2021 | Hemmelgarn | B01F 7/00975 | |
| 2021/0237310 | A1 * | 8/2021 | Scott | B28C 5/143 | |

* cited by examiner

PORTABLE CONSTRUCTION MIXER

CROSS-REFERENCE TO RELATED APPLICATION

The present disclosure claims the benefit of U.S. Provisional Application No. 62/899,420 filed on Sep. 12, 2019, the contents of which are hereby incorporated herein in entirety.

FIELD OF THE DISCLOSURE

The present disclosure relates generally to a grout and mortar mixer, and more specifically to a portable grout and mortar mixer that may mix and dispense grout or mortar.

BACKGROUND

Grout, mortar, and like substances require periodic agitation and tempering to maintain fluidity. Typically, large stationary mixing machines are on the jobsites. Often the point of use for the mixture is separated from the location in which the substance was mixed. In this scenario, a worker must travers a jobsite to deliver the substance to the required location. Alternatively, small batches may be individually mixed by a worker closer to the point of use. Regardless, properly mixing and delivering the substance to the point of use in many worksites is difficult. Further, the current grout and mortar mixing process often involves dumping the material into wheelbarrows or buckets, and transporting the product to the point of use. If the transported material is not the correct consistency, it may need to be returned to the mixer or disposed of.

Further, modern mixer bearings often need to be replaced frequently. To replace bearings, the current mixer machines being used in the industry require some disassembly and reassembly. Many modern day mixes have key joints for the shafts of the mixers. Key joints make assembly and disassembly of machines more difficult, and thus the assembly and disassembly of the machines is often not done in the field.

SUMMARY

One embodiment of the present disclosure is a portable mixer comprising a first auger with a first auger shaft and first auger blades. There is also a second auger with a second auger shaft and second auger blades. The portable mixer has a motor. The portable mixer has a material loading location where material may be loaded into the mixer. There is also a dispensing conduit where material can be discharged. The motor powers both the first auger and the second auger. The first auger can rotate in a first rotational direction and a second rotational direction, and the first auger may mix the material in both directions. The second auger may rotate in the first rotational direction and the second rotation direction. When the second auger rotates in one direction, it prevents the material from dispensing, and when the second auger moves in the opposite direction, it distributes the material through the dispensing conduit.

In one example of this embodiment, there is a first hydraulic motor hose and a second hydraulic motor hose. These hydraulic motor hoses distribute power from a power source to the motor. Further, these hoses may be coupled to the motor with swivel elbows. The motor is anchored to the portable mixer with a hydraulic motor bracket.

In another example of this embodiment, the first auger of the portable mixer is rotationally coupled to the second auger. The portable mixer further comprises of a trough tray and a housing. The housing encloses the first and second augers in a manner that allows the transfer of material between the first auger and the second auger. The housing surrounding the first auger is at least partially cylindrical, and the housing that surrounds the second auger is also at least partially cylindrical.

In another example of this embodiment, the housing that surrounds the second auger also includes a removable trough tray. The housing around the first auger is at least partially open at a material loading location, which is at least partially covered by a grate. The grate has a bag buster, and may be secured to the housing with a first grate wire lock and a second grate wire lock. The hosing also comprises of a first and second adjustable plate, where the first adjustable plate is located at the first end of the housing and the second adjustable plate is located at the second end of the housing. Moving the adjustable plate may move a rotational axis of the first auger.

In another example of this embodiment, the dispensing conduit of the portable mixer comprises of a cylindrical pipe that is substantially cylindrical in shape, a first and second flange, and a cone pipe that is substantially conical in shape. The cylindrical pipe is connected to the cone pipe with the first flange ring, and it is connected to the housing by a second flange ring. Further, the smaller end of the cone pipe may connect to a hose.

In another example of this embodiment, the first auger shaft has a greater circumference than the second auger shaft, and the first auger blades have a greater circumference than the second auger blades. In this examples, the second auger blades rotate with more rotations per minute than the first auger blades.

In another example of this embodiment, the portable mixer contains a first sprocket, a second sprocket, a third sprocket, a fourth sprocket, a first chain and a second chain. In this example, the first sprocket is rotationally coupled to, and is powered by, the motor. The second sprocket is coupled to the first sprocket with the first chain, and the second sprocket is rotationally coupled to the second auger. The third sprocket is rotationally coupled to the second auger, and the third sprocket is coupled to the fourth sprocket with the second chain. Finally, the fourth sprocket is rotationally coupled to the first auger, and the fourth sprocket is larger than the first, second, and third sprockets. In this example, the portable mixer further comprises a safety chain guard, wherein the safety chain guard at least partially covers the chains and sprockets.

In another example of this embodiment, the portable mixer comprises a first bearing assembly, a second bearing assembly, and a third bearing assembly. Further, the first auger shaft has a first end and a second end, and the second auger shaft has a first end and a second end. The first auger shaft is supported by the first bearing assembly at the first end and is supported by the second bearing assembly at the second end. The second auger shaft is supported by a third bearing assembly at the first end. Further, in this example, the first bearing assembly, second bearing assembly, and third bearing assembly are mounted to the exterior surface. The bearing assemblies further comprise of a system that provides access to lubricate the bearing assemblies.

In another example of this embodiment, the second auger shaft is coupled to the motor at the first end, and the second end of the second auger shaft is positioned between the first end and the terminus of the cone pipe. The first auger shaft is coupled to a bearing assembly and sprocket on one end, and a bearing assembly on the other end. The first auger shaft is substantially parallel to the second auger shaft. In this example, the first auger shaft and the second auger shaft both have hexagonal shaped cross sections.

Another example of this embodiment includes a left fork tube and a right fork tube. In this example, both the left and right fork tubes are coupled to the mixer, and the left fork tube is positioned to be offset to a first side and the right fork tube is positioned to be offset to a second side.

Another embodiment is an attachment to a working vehicle, which comprises a machine that can mix material when the mixers are rotating in a first rotational direction and dispense material when the mixers are rotating in the second rotational direction. In this embodiment, the machine is portable, and the machine may mix and dispense while being transported by a working vehicle.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

Figure 1:
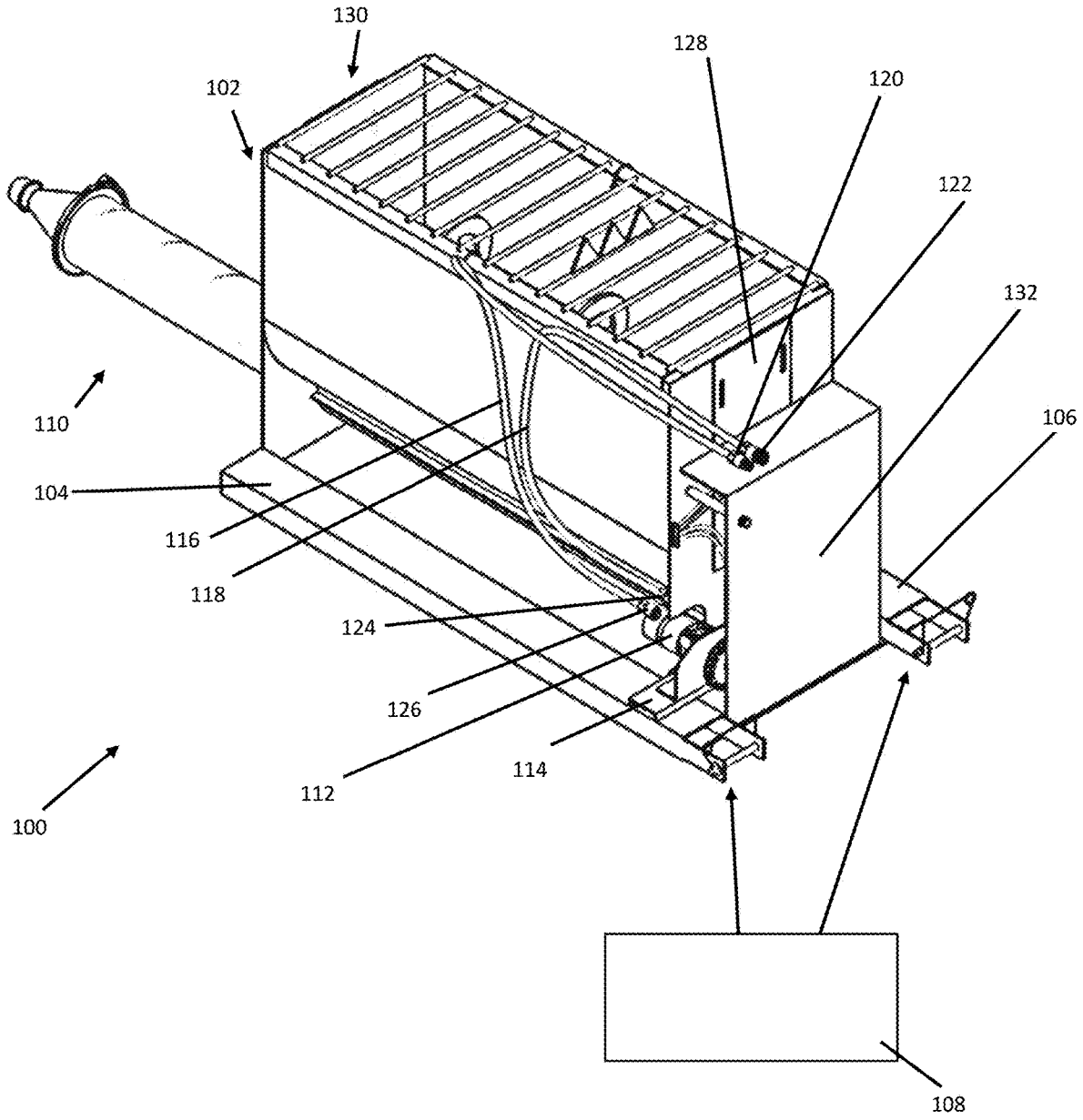
FIG. 1 is an elevated perspective view of a portable mixer.

For the purposes of promoting an understanding of the principles of the present disclosure, reference will now be made to the embodiments described herein and illustrated in the drawings and specific language will be used to describe the same. It will nevertheless be understood that no limitation of the scope of the present disclosure is thereby intended, such alterations and further modifications in the illustrated devices and methods, and such further applications of the principles of the present disclosure as illustrated therein being contemplated as would normally occur to one skilled in the art to which the present disclosure relates.

A portable mixer 100 is illustrated in FIG. 1. The portable mixer 100 may have a housing 102. The housing 102 is used to contain a material and provide a structural coupling point for components of the portable mixer 100 among other things. In one aspect of this disclosure, the housing 102 may configured to mix and distribute construction material such as mortar, grout, cement, and the like.

The portable mixer 100 may be configured to be coupled to a working vehicle 108. In one non-exclusive example, the portable mixer 100 may have a left fork tube 104 and a right fork tube 106 sized to receive corresponding left and right fork members of the working vehicle 108 to allow the portable mixer 100 to be transported therewith. The working vehicle 108 may be any machine known in the art with auxiliary power connections such as a forklift, a telescopic handler, a skid steer, and the like. While the portable mixer 100 is being transported by the working vehicle 108, it may mix the material, or distribute the material through a dispensing conduit 110 as discussed herein.

The portable mixer 100 has a motor 112 that is configured to power to the portable mixer 100 to mix and dispense material. The motor 112 may be coupled to the fork tubes 104, 106 with a motor bracket 114 which anchors the motor 112 to the portable mixer 100. In one aspect of this disclosure, the working vehicle 108 may provide power to the motor 112 through an auxiliary power connection. In one example, the auxiliary power connection may provide a fluid coupling to a hydraulic system of the working vehicle. In this embodiment, the motor 112 may be a hydraulic motor that is fluidly coupled to the hydraulic system of the working vehicle 108 by a first hydraulic motor hose 116 and a second hydraulic motor hose 118.

While a hydraulic system is discussed herein for powering the motor 112, other embodiments may utilize the working vehicle's 108 pneumatic or electrical system as well. Accordingly, while the motor is described in one example as a hydraulic motor, in other embodiments it may be a pneumatic or electric motor. Further, while a single motor is discussed herein, this disclosure contemplates any number of motors to power the portable mixer 100 and the single motor is only one non-limiting example.

The first hydraulic motor hose 116 may have a male flat faced hose fitting 120 that couples to the working vehicle 108. The second hydraulic motor hose 118 may have a female flat faced hose fitting 122 that couples with the working vehicle 108. The hydraulic motor hoses 116, 118 may each be 10.5 feet in length, or any other appropriate length to connect the portable mixer 100 to the working vehicle 108.

The first hydraulic motor hose 116 may be coupled to the hydraulic motor 112 through a first swivel elbow 124, and the second hydraulic motor hose 118 may be coupled to the hydraulic motor 112 through a second swivel elbow 126. In the current embodiment, the angle of the swivel elbows 124, 126 are each about 90 degrees. Additionally, the first and second hydraulic motor hoses 116, 118 may be coupled to the hydraulic motor 112 with any type of coupler known in the art. While the swivel elbow in the present disclosure is about 90 degrees, in another embodiment the angle of the swivel elbows 124, 126 could be greater than about 90 degrees. In another embodiment, the angle of the swivel elbows 124, 126 could be less than about 90 degrees. Further, while swivel elbows 124, 126 are discussed herein, the hoses 116, 118 may be coupled to the motor 112 utilizing any known hydraulic coupler that can address the expected hydraulic loads of the motor 112

Figure 2:
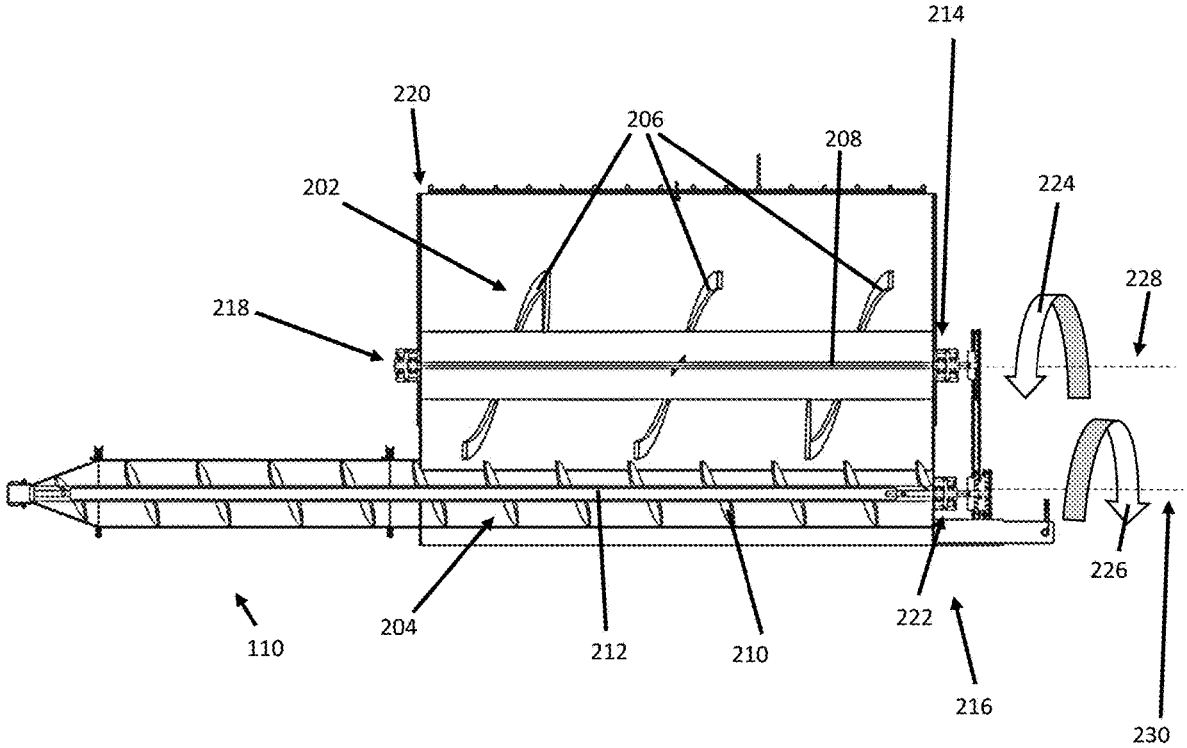
FIG. 2 is a side half section view of the portable mixer of FIG. 1 with the safety chain guard removed.

A half-section view of the portable mixer 100 along a longitudinal axis is illustrated in FIG. 2. In one aspect of this disclosure, the motor 112 powers both a first auger 202 and a second auger 204. The first auger 202 may be rotationally coupled to the second auger 204 wherein rotation of the first auger 202 also causes the second auger 204 to rotate. The first auger 202 may have a first auger blade 206 helically defined about a first auger shaft 208. The first auger blade 206 may be defined so there are several contact points coupling the first auger blade 206 with the first auger shaft 208. However, except for the several contact points, the first auger blade 206 may be radially spaced from the first auger shaft 208. By spacing the first auger blade 206 from the first auger shaft 208, material may be substantially mixed as the first auger 202 rotates. While the disclosure describes the first auger 202 with the first auger blade 206 spaced from the first auger shaft 208, in another embodiment the first auger blade 206 may be substantially continuously coupled to the first auger shaft 208.

The second auger 204 may have a second auger blade 210 and a second auger shaft 212. The second auger blade 210 may be substantially continuously coupled to the second auger shaft 212. While a single first and second blade 206, 210 are discussed herein, other embodiments may include more than one blade coupled to the corresponding shafts. Accordingly, this disclosure contemplates utilizing more than one blade helically coupled to each shaft as well.

In the current disclosure, both the first auger shaft 208 and the second auger shaft 212 are about 1.25 inches in diameter with hexagonal cross-sections. In this embodiment, the first auger 202 is a right hand screw, and the second auger 204 is a left hand screw. Thus, although the augers 202, 204 may rotate in the same rotational direction, because the first auger 202 is a right hand screw and the second auger 204 is a left hand screw, the augers 202, 204 will be pushing material in different directions. When the second auger 204 rotates in a second rotational direction 226, the second auger 204 will prevent the material from dispensing through the dispensing conduit 110. When the second auger 204 rotates in the second rotational direction 226, the first auger 202 may also rotate in the second rotational direction 226, and the first auger blades 206 and the second auger blades 210 will temper and mix the material. However, when the second auger 204 rotates in a first rotational direction 224, the second auger blades 210 may dispense any material located therein through the dispensing conduit 110.

In another embodiment, the first auger 202 is a left hand screw, and the second auger 204 is a right hand screw. In this embodiment, when the second auger 204 rotates in the first rotational direction 224, the second auger 204 will prevent the material from dispensing, and the first auger 202 may also rotate in the first rotational direction 224. In this embodiment, when the second auger 204 rotates in the first rotational direction 224, the first and second auger blades 206, 210 will temper and mix the material. Alternatively, when the second auger 204 rotates in the second rotational direction 226, the second auger blades 210 will dispense the material through the dispensing conduit 110.

While the embodiments above describe specific combinations of right hand screw and left hand screw between the first auger 202 and the second auger 204, any combination of right hand screw and left hand screw may be used for the augers 202, 204. More particularly, a person skilled in the art understands that as the second auger 204 rotates in a direction moving material away from the dispensing conduit 110, the portable mixer 100 may not dispense material from the dispensing conduit 110 but rather be in a mixing configuration. Alternatively, when the mixing direction of the second auger 204 is reverses, the portable mixer 100 may be in a dispensing configuration wherein material is delivered out of the dispensing conduit 110.

Utilizing a second auger blade 210 that is substantially continuously coupled to the second auger shaft 212 improves the ability to dispense the material out of the dispensing conduit 110 when the second auger 204 is rotating in the appropriate direction. Having second auger blade 210 that is continuously coupled to the second auger shaft 212 also improves the ability for the second auger 204 to prevent the material from passing through the dispensing conduit 110 when rotating in the appropriate direction.

The first auger shaft 208 is coupled to a first bearing assembly 214 at a first end 216 and to a second bearing assembly 218 at a second end 220. The second auger shaft 212 is coupled to a third bearing assembly 222 at the first end 216, and the second auger shaft 212 is suspended within the dispensing conduit 110 at the second end 220. In other words, the second auger shaft 212 is not coupled to a bearing assembly at the second end 220. The first auger shaft 208 may be substantially parallel to the second auger shaft 212. Further, the bearing assemblies 214, 218, 222 may be flush mounted to the exterior of the housing 102. By flush mounting the bearing assembly 214, 218, 222 to the housing 102, the bearing assemblies 214, 218, 222 may easily be accessed for maintenance and replacement.

In one aspect of this disclosure, the radially outermost portion of the first auger 202 may pass closely by the radially outermost portion of the second auger 204. By spacing the augers 202, 204 so the blades pass closely by one another, the augers 202, 204 may substantially contact and mix any material in the portable mixer. By contacting substantially all of the material in the portable mixer 100 due to the spacing of the augers 202, 204, "dead spots" of unmixed material within the portable mixer 100 may be greatly reduced if not eliminated.

The first auger 202 may be coupled to a first adjustable plate 128 and second adjustable plate 130. The first adjustable plate 128 is coupled to the housing 102 of the portable mixer 100 at the first end 216, and the second adjustable plate 130 is coupled to the housing 102 of the portable mixer 100, at the second end 220. The first and second adjustable plates 128, 130 may be displaced in a vertical direction. When the first and second adjustable plates 128, 130 are displaced, the first auger 202 is also similarly displaced from the second auger 204. Displacing the first auger 202 will also displace a first axis 228 in a similar distance and direction. Accordingly, displacing the first auger 202 away from the second auger 204 with the adjustable plates 128, 130 will increase the distance between the first auger 202 and second auger 204.

In one aspect of this disclosure, the portable mixer 100 has a first and second auger shaft 208, 212 with a hexagonal cross-section. In this configuration, the shafts 208, 212 do not require a key joint, and disassembly of the machine can be done in the field. Utilizing hexagonal cross sections for the auger shafts 208, 212 may facilitate less complicated replacement of the bearing assemblies 214, 218, 222 among other things.

Both the first auger 202 and the second auger 204 may rotate in the first rotational direction 224, and the second rotational direction 226. In one aspect of this disclosure, the first auger blades 206 have a larger external radius than the second auger blades 210. Further, as discussed herein, the first auger blades 206 are spaced from the first auger shaft 208 except for several contact points. This type of configuration may be referred to as a ribbon auger. Using a ribbon auger design for the first auger 202 may help mix and temper the material more effectively than the typical auger design.

Figure 3:
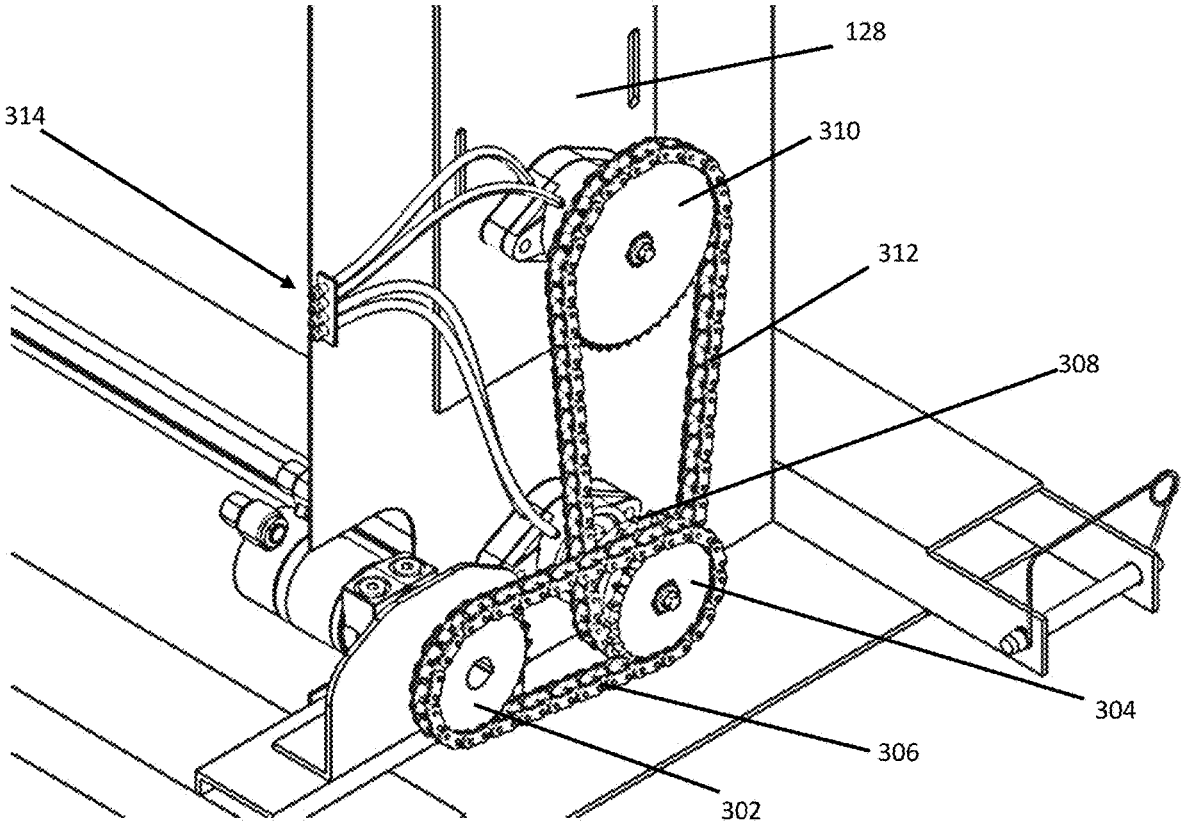
FIG. 3 is a partial view of a drive assembly of the portable mixer of FIG. 1.

In one aspect of this disclosure, the motor 112 is rotationally coupled to both the second auger shaft 212 and the first auger shaft 208 thru chains and sprockets, as illustrated in FIG. 3. A drive shaft of the motor 112 may be rotationally coupled to a first sprocket 302. The first sprocket 302 is also rotationally coupled to a second sprocket 304 with a first chain 306. Further, the second sprocket 304 may be coupled to the second auger shaft 212. Thus, the motor 112 rotates the second auger shaft 212 by rotating the first sprocket 302, which, through the first chain 306, rotates the second sprocket 304, which rotates the second auger shaft 212.

A third sprocket 308 may be coupled to the second auger shaft 212 as well. The third sprocket 308 is also coupled to a fourth sprocket 310 by a second chain 312. The fourth sprocket 310 is coupled to the first auger shaft 208 to rotate therewith. Thus, the second auger shaft 212 is rotationally coupled to the first auger shaft 208 via the chain 312 and sprockets 310, 308. Thus, power is transmitted from the motor 112 to the second auger shaft 212 via the sprockets 302, 304, and chain 306. Further, the first shaft 208 rotates along with the second shaft 212 via the second chain 312 and sprockets 308, 310.

In one aspect of this disclosure, the portable mixer 100 may contain a safety chain guard 132 that at least partially covers the chains and sprockets. While chains and sprockets are described above, the motor 112 can be coupled to the first auger shaft 208 and the second auger shaft 212 by other systems known in the art, such as a belt and pulley system or a directly meshed gear assembly.

In one embodiment, the first sprocket 302, the second sprocket 304, and the third sprocket 308 are all twenty-two tooth sprockets. The fourth sprocket 310 is a fifty tooth sprocket, and is larger than the first, second, and third sprockets 302, 304, 308. Accordingly, the fourth sprocket 310 rotates at a slower speed than the first, second, and third sprockets 302, 304, 308 because the fourth sprocket 310 is larger than the other sprockets 302, 304, 308 and all of the sprockets are powered by the same source. Due to this configuration, the first auger shaft 208 may rotate at a slower speed than the second auger shaft 212 because the first auger shaft 208 is coupled to the larger fourth sprocket 310.

While specific sprocket configurations are discussed herein, this disclosure contemplates utilizing different configurations and those presented are only exemplary. Accordingly, other configurations may incorporate sprockets having more or less teeth than those discussed herein. Further, while the first auger is described herein as rotating slower than the second auger, in other embodiments the first auger may rotate faster than the second auger. Further still both the first auger and the second auger may rotate at substantially the same speed. Accordingly, this disclosure contemplates many different sprocket size configurations that allow many different rotational speed variations between the two augers.

Further in FIG. 3 is a first lubrication system 314. The first lubrication system 314 may be positioned to allow access to a lubricating circuit for the first and third bearing assemblies 214, 222. Further, the lubricating circuit of the second bearing assembly 218 may be accessible from the exterior of the portable mixer 100. In one embodiment, the first lubrication system 314 consists of a first greasing assembly coupled to the first and third bearing assemblies 214, 222 with four eighteen inch hoses. In this embodiment, a second greasing assembly is coupled to the second bearing assembly 218 with hoses. In another embodiment, the bearing assemblies 214, 216, 222 are coupled to a grease block. The grease blocks each have exterior nipples, which allow an exterior source to deliver grease to the grease blocks without disassembling the bearing assemblies 214, 218, 222. The bearing assemblies 214, 218, 222 may further be lubricated without being disassembled by any means known in the art.

Figure 4:
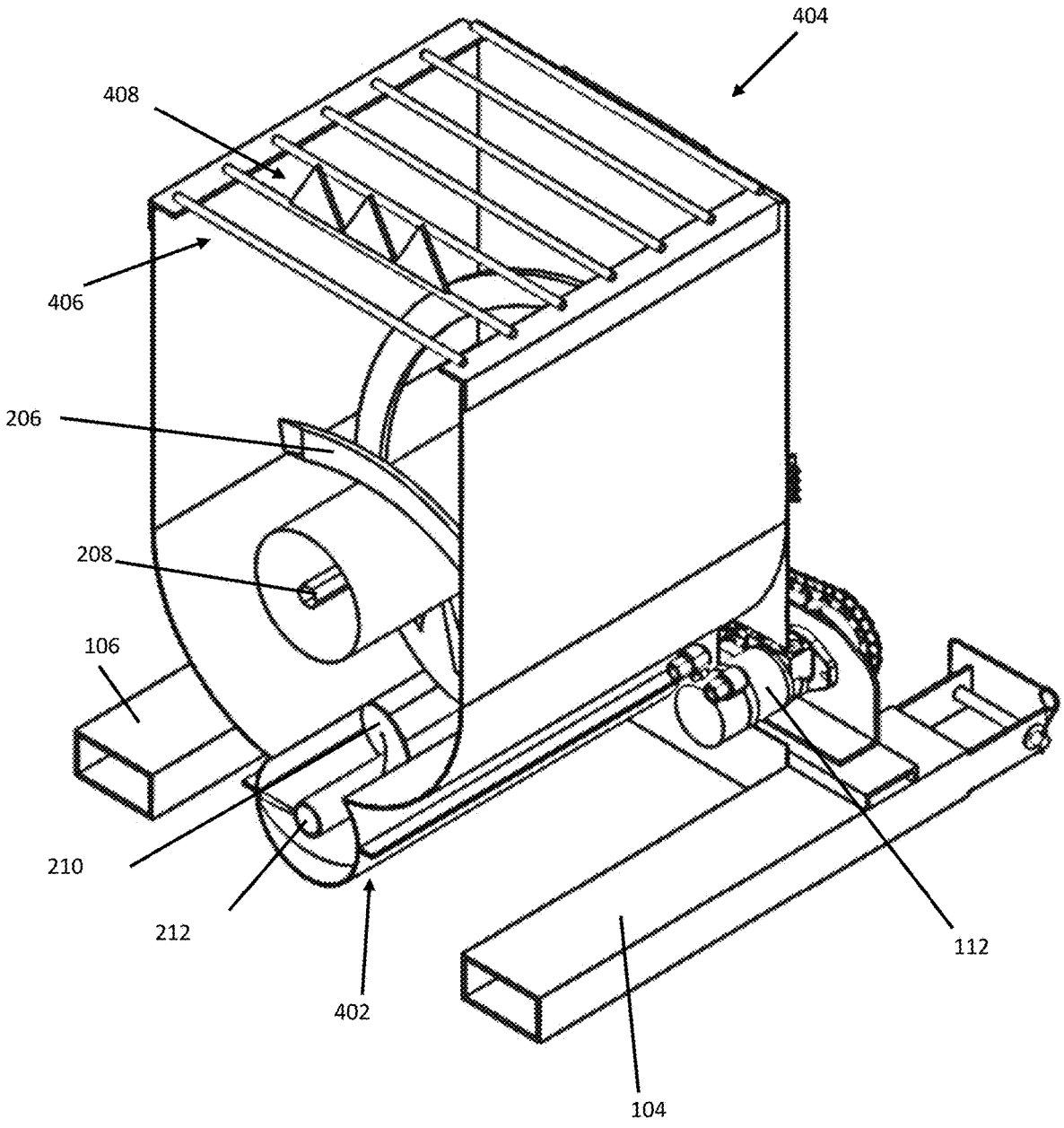
FIG. 4 is another cross-sectional view of the portable mixer of FIG. 1.

The housing 102 is shown in FIG. 1, and allows the transfer of material between the first auger 202 and the second auger 204. The housing 102 that surrounds the first auger 202 is shaped at least partially cylindrical, and the housing 102 that surrounds the second auger 204 is shaped at least partially cylindrical. As shown in FIG. 4 a trough tray 402 is comprised of at least a portion of the partially cylindrical housing 102 that surrounds the second auger 204. Having partially cylindrical housing 102 around the first auger 202 and second auger 204 aids in the mixture of material.

The trough tray 402 may be a removable section of the housing 102. In one embodiment, the trough tray 402 is half of a pipe cut lengthwise, the pipe being 8 inches in diameter, and 60 inches in length. The trough tray 402 is removable, partially because it is a high wear item. This removability aspect of the trough tray 402 minimizes cost and time to replace the trough tray 402, because the trough tray 402 may be removed from the portable mixer 100 without requiring a substantial disassembly of other components of the portable mixer 100.

As shown in FIG. 4, the housing 102 is at least partially open at a material loading location 404. A grate 406 may partially cover the material loading location 404. The grate 406 may, among other things, prevent larger items such as mortar and grout bags from falling through the material loading location 404 and into the portable mixer 100. The grate 106 may also contain a bag buster 408. The bag buster 408 may help open bags of material, making it easier to load bags of material, such as mortar or grout, into the portable mixer 100.

Figure 5:
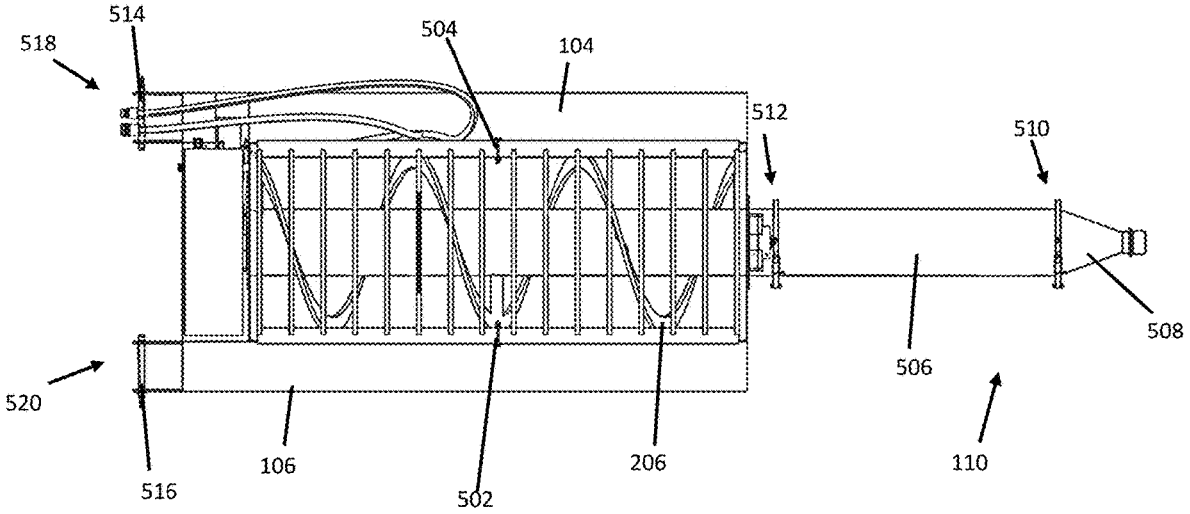
FIG. 5 is an overhead view of the portable mixer of FIG. 1.

As seen in FIG. 5, the grate 406 may be secured to the housing 102 of the portable mixer 100 with a first grate wire lock 502 and a second grate wire lock 504. The dispensing conduit 110 is also pictured in FIG. 5. The dispensing conduit 110 has a cylindrical pipe 506 that is substantially cylindrical in shape and is coupled to a cone pipe 508, which is substantially conical in shape. The side of the cone pipe 508 with the larger radius is located closer to the portable mixer 100 than the side of the cone pipe 508 with the smaller radius. The cylindrical pipe 506 is connected to the cone pipe 508 with a first flange ring 510. The cylindrical pipe 506 is connected to the housing 102 with a second flange ring 512. The flange rings 510, 512 facilitate for a quick disconnect of the dispensing conduit 110. The side of the cone pipe 508 with the smaller radius may terminate with a three inch ball end with a coupler for a grout hose. When the second auger 204 rotates in the appropriate rotational direction, the material will travel down the cylindrical pipe 506 and through the cone pipe 508. The material may be dispensed through the end of the cone pipe 508; or, if a hose is attached to the cone pipe 508, the material may be dispensed through the hose.

Also pictured in FIG. 5 are a left fork tube safety pin 514 and a right fork tube safety pin 516. The left and right fork tube safety pins 514, 516 secure the attachment between the left and right fork tubes 104, 106 and the working vehicle 108. The left fork tube 104 is positioned to be offset to a first side 518, and the right fork tube 106 is positioned to be offset to a second side 520. In the current disclosure, the left fork tube safety pin 514 is positioned on the first side 518 of the first end 216 of the portable mixer 100, and the right fork tube safety pin 516 is positioned on the second side 520 of the second end 220 of the portable mixer 100. While safety pins is described in this disclosure, any method to secure a working vehicle 108 to an attachment may be used.

In use, the work vehicle 108 may be coupled to the portable mixer 100 via the fork tubes 104, 106. More specifically, corresponding forks of the work vehicle 108 may be positioned within the fork tubes 104, 106 and the pins 514, 516 may be positioned there through to substantially couple the portable mixer 100 to the work vehicle 108. Next, the motor 112 may be coupled to the auxiliary power supply of the work vehicle 108 to selectively power the portable mixer 100. In the hydraulic motor 112 embodiment, the hydraulic hoses 116, 118 may be fluidly coupled to the hydraulic system of the work vehicle 108 to selectively provide hydraulic power to the motor 112. The pressure and flow direction of the hydraulic fluid through the hoses 116, 118 may be selectively controlled via controls of the work vehicle 108. As explained herein, in other embodiments the motor 112 may be powered by electrical or pneumatic systems and be coupled to a pneumatic or electrical system of the work vehicle 108.

Regardless the type of motor 112, once the portable mixer 100 is coupled to the work vehicle 108, both structurally through the fork tubes 104, 106 and to the power system to power the motor 112, the work vehicle 108 may move around while carrying the portable mixer 100. Further, the motor 112 may selectively alter rotation speed and direction to transition the portable mixer 100 between the mixing rotation pattern wherein material is not moved out the dispensing conduit 110 and the dispensing rotation pattern wherein material within the portable mixer 100 is moved out the dispensing conduit 110.

To prepare a material such as grout or mortar, the portable mixer 100 may be set to power the motor 112 in the mixing rotation pattern. Next, mortar or grout and water may be introduced into the housing 102 through the grate 406 at the material loading location 404. The mortar or grout material may be mixed by the first and second auger 202, 204 as the motor 112 rotates the augers 202, 204 in the mixing rotation pattern. Further, because the mixing rotation pattern rotates the second auger 204 to move material away from the cone of the dispensing conduit 110, no substantial amount of material exits the portable mixer 100 when in the mixing rotation pattern. Rather, the mortar or grout is continuously mixed with the water or the like.

Once the mixture is the ideal consistency, the work vehicle 108 may take the portable mixer 100 to any desired point of use. Once at the desired point of use, the operator may switch the rotation pattern of the motor 112 from the cab by switching the flow of the auxiliary power provide to the motor 112. At this point, the augers 202, 204 may begin to rotate in the dispensing direction wherein the second auger 204 is moving the mixture through the dispensing conduit 110 towards the cone 508. The second auger 204 may then force the mixture out the end of the cone 508 where it is applied to the work site as needed. As discussed herein, in one embodiment a hose may be coupled to the end of the cone 508 to thereby direct the application of the mixture to the work site.

Once all of the required mixture is dispensed at the worksite, the operator may transition the motor 112 back to the mixing rotation direction wherein the mixture is no longer forced out of the dispensing conduit 110. Once back in the mixing rotation direction, the working vehicle 108 may travel with the portable mixer 100 to a different worksite location wherein the portable mixer 100 may again revers the rotation pattern of the augers 202, 204 to provide any needed mixture to the worksite.

In summary, the portable mixer 100 provides an easy and efficient apparatus for both mixing and dispensing a mixture at a work site. When the mixture is not being dispensed, it is undergoing a mixing process to remain usable. Further, the properly mixed material can be easily dispensed as desired from the cab of the working vehicle or otherwise.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A portable mixer, comprising:
- a first auger configured to rotate about a first axis;
- a second auger configured to rotate about a second axis;
- a motor;
- a material loading location, where material may be loaded into the mixer;
- a dispensing conduit;
- a first adjustable plate; and
- a second adjustable plate;
- wherein, the motor powers both the first auger and second auger;
- further wherein, the second auger may rotate in a first rotational direction and a second rotational direction;
- wherein, the second auger substantially prevents material from exiting a dispensing conduit when the second auger rotates in the first rotational direction and the second auger distributes material through the dispensing conduit when the second auger rotates in the second rotational direction
- wherein, the first auger is rotationally coupled to the first and second adjustable plate;
- wherein, the first and second adjustable plates are slidably coupled to a housing to alter a spacing between the first axis of the first auger and the second axis of the second auger.

2. The portable mixer of claim 1, further wherein the motor is a hydraulic motor.

3. The portable mixer of claim 2, wherein the hydraulic motor is coupleable to a hydraulic system of a work vehicle to selectively power the hydraulic motor.

4. The portable mixer of claim 1, wherein the first auger is rotationally coupled to the second auger.

5. The portable mixer of claim 1, wherein the housing at least partially encloses the first auger and a trough tray and is at least partially defined about the second auger.

6. The portable mixer of claim 5, further wherein a portion of the housing surrounding the first auger has a cylindrical profile section that substantially corresponds with the outer profile of the first auger.

7. The portable mixer of claim 6, further wherein a portion of the housing surrounding the second auger has a cylindrical profile section that substantially corresponds with the outer profile of the second auger.

8. The portable mixer of claim 7, further wherein the trough tray is removably coupled to the housing along the second auger.

9. The portable mixer of claim 5, wherein the housing defines a material loading location configured to receive material.

10. The portable mixer of claim 9, wherein the material loading location is at least partially covered by a grate that has a bag buster positioned thereon.

11. The portable mixer of claim 1, wherein the dispensing conduit further comprises:
- a cylindrical pipe that is substantially cylindrical in shape;
- a first flange and a second flange; and
- a cone pipe that is substantially conical in shape;
- wherein, the cylindrical pipe is removably connected to the cone pipe with a first flange ring of the first flange;

further wherein, the cylindrical pipe is removably connected to the housing by a second flange ring of the second flange.

12. The portable mixer of claim 11, further wherein the cone pipe is coupleable to a hose to distribute material through the hose when the second auger is rotating in the second direction.

13. The portable mixer of claim 1, wherein a first blade of the first auger has a greater radius than a second blade of the second auger.

14. The portable mixer of claim 1, further wherein the second auger rotates faster than the first auger.

15. The portable mixer of claim 1, comprising a plurality of sprockets and at least one chain, wherein the motor drives at least one sprocket to rotationally drive the first and second auger.

16. The portable mixer of claim 1, comprising a bearing assembly rotationally coupling the second auger to a housing on a first end wherein a second end of the second auger is substantially suspended within the dispensing conduit.

17. The portable mixer of claim 1, further wherein the first and second augers have corresponding first and second auger shafts that have hexagonal shaped cross sections.

18. The portable mixer of claim 1, further comprising a lubrication system that provides a single location to lubricate a plurality of bearing assemblies.

* * * * *